US006740833B1

(12) United States Patent
Lai

(10) Patent No.: US 6,740,833 B1
(45) Date of Patent: May 25, 2004

(54) ELECTRICAL SWITCH

(75) Inventor: Yuk Kuen Lai, Chaiwan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/443,774

(22) Filed: May 23, 2003

(51) Int. Cl.[7] ..... H01H 19/20
(52) U.S. Cl. ..... 200/570; 200/11 A; 200/6 BAH
(58) Field of Search ..... 200/570, 6 BA, 200/6 BB, 11 R, 11 A, 11 G, 6 R

(56) References Cited

U.S. PATENT DOCUMENTS 3,748,419 A * 7/1973 Torrey et al. ..... 200/570
4,450,323 A * 5/1984 Iitsuka ..... 200/1 V
5,343,004 A * 8/1994 Chen ..... 200/11 R
5,581,059 A * 12/1996 Chang ..... 200/11 G
5,728,982 A * 3/1998 Rao et al. ..... 200/6 R
5,739,775 A * 4/1998 Brandestini ..... 341/10

* cited by examiner

*Primary Examiner*—Lincoln Donovan
*Assistant Examiner*—K. Lee
(74) *Attorney, Agent, or Firm*—Leydig, Voit & Mayer, Ltd.

(57) ABSTRACT

An electrical switch comprising a casing, an operator, a plurality of fixed contacts and a moving contact. The moving contact is movable by the operator to come into contact with and out of contact from the fixed contacts. The casing has a hole for insertion of an electric cable. At least one of the fixed contacts has a resilient end positioned behind the hole and deflectable inwards by an end of the cable upon insertion, a part integral with the contact end, and a separate conductor in electrical contact with the contact part and positioned adjacent the contact end. The contact end is operable to press the cable end, while being deflected thereby, against the conductor, together providing a double-aided electrical contact to the cable end.

9 Claims, 3 Drawing Sheets

ELECTRICAL SWITCH

The present invention relates to an electrical switch and, more particularly but not exclusively, to a rotary switch.

BACKGROUND OF THE INVENTION

Electrical switches are normally connected by electric cables to other parts of an electrical circuit. For those switches having external terminals, the cables are often connected thereto by soldering. Cable connection of the self-gripping type is known, in which an internal fixed contact is configured to have a resilient end behind a hole. Upon insertion of an electric cable into the hole, the contact end is deflected inwards to thereby grip the cable end against a surface on the opposite side. As the grip of the contact end upon the cable end is often small in area, the resulting contact may not be satisfactory in terms of contact resistance.

The invention seeks to mitigate or at least alleviate such a problem by providing an improved electrical switch.

SUMMARY OF THE INVENTION

According to the invention, there is provided an electrical switch comprising a casing, an operator supported by the casing for movement, and a plurality of fixed contacts and a moving contact in the casing. The moving contact is movable by the operator to come into contact with and out of contact from the fixed contacts. The casing has a hole for insertion of an electric cable. At least one of the fixed contacts has a resilient end positioned behind the hole and deflectable inwards by an end of the cable upon insertion, a part integral with the contact end, and a separate conductor in electrical contact with the contact part and positioned adjacent the contact end. The contact end is operable to press the cable end, while being deflected thereby, against the conductor, together providing a double-sided electrical contact to the cable end.

Preferably, said at least one fixed contact, including the conductor, has a generally triangular structure.

More preferably, said at least one fixed contact has one section providing the contact end and another section providing the contact part, the two sections together with the conductor representing respective sides of the structure.

In a preferred embodiment, said at least one fixed contact comprises a generally Z-shaped body having a front section for contact by the moving contact, a rear section providing the contact end, and a middle section extending therebetween.

More preferably, the fixed contact body includes a bend between the front and middle sections, the bend providing the contact part.

It is preferred that the casing includes a side wall having an inner surface, lying against which the conductor is fixed.

It is further preferred that the conductor has one end engaged by a recess adjacent the inner surface and an opposite end pressed by the contact part against the inner surface.

In a specific construction, the operator is supported within the casing for rotation, the fixed contacts are disposed around the operator, and the moving contact is mounted on the operator for rotation therewith.

More specifically, the electrical switch is a rotary switch with the operator being rotatable over 360° in opposite directions.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
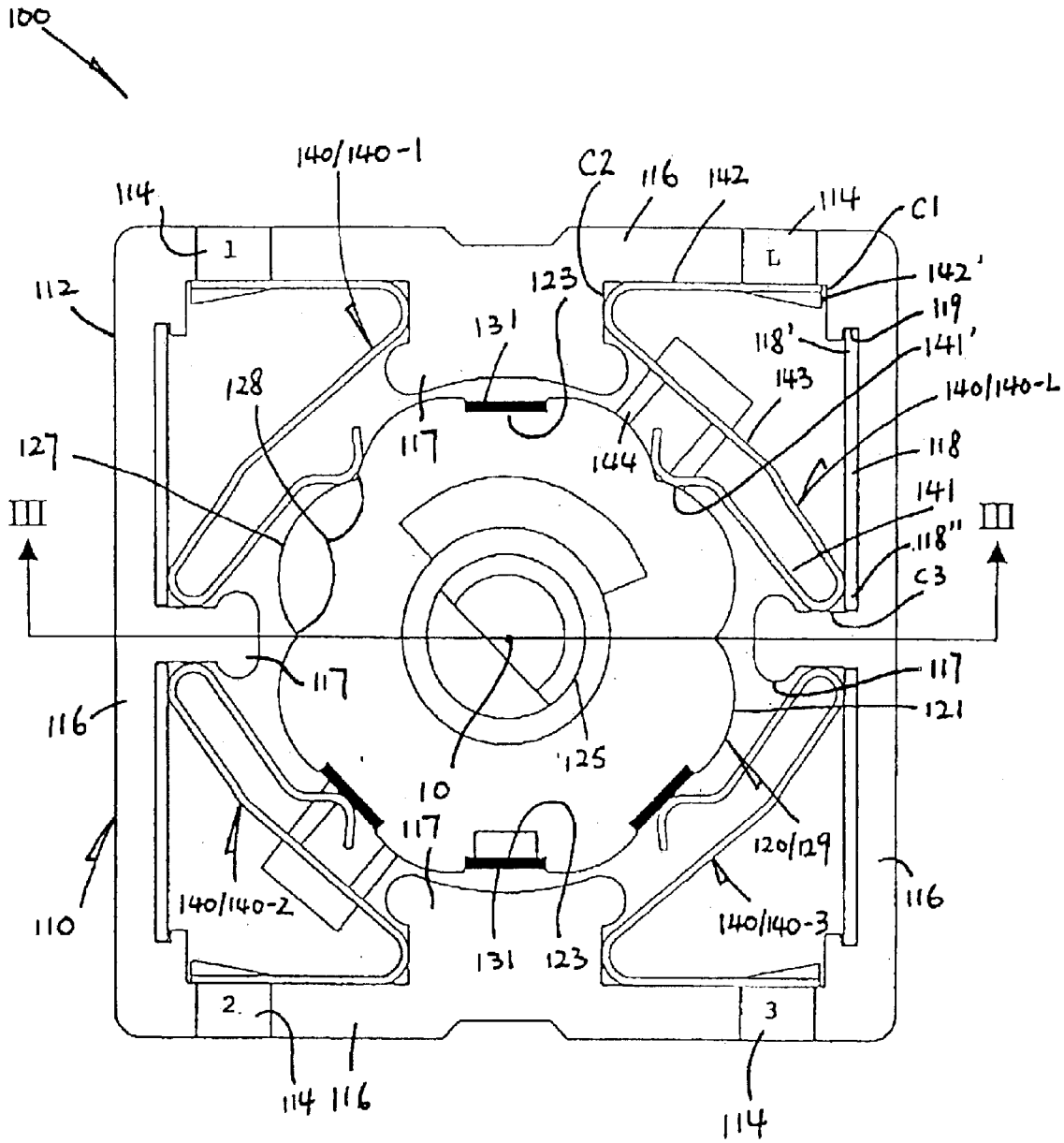
FIG. 1 is a top plan view showing the interior of an embodiment of an electrical switch in accordance with the invention.
Figure 2:
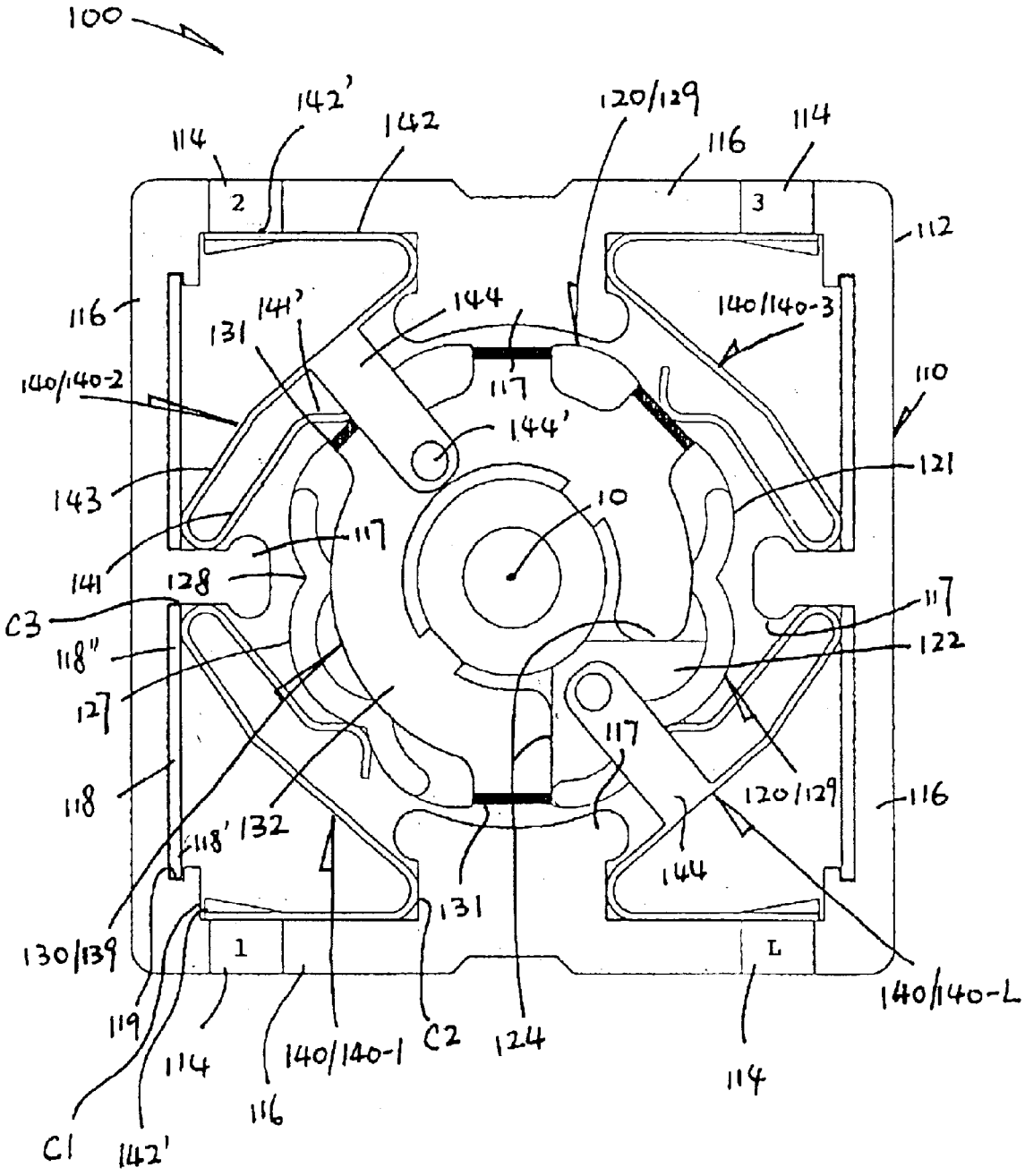
FIG. 2 is a bottom plan view of the electrical switch of FIG. 1.
Figure 3:
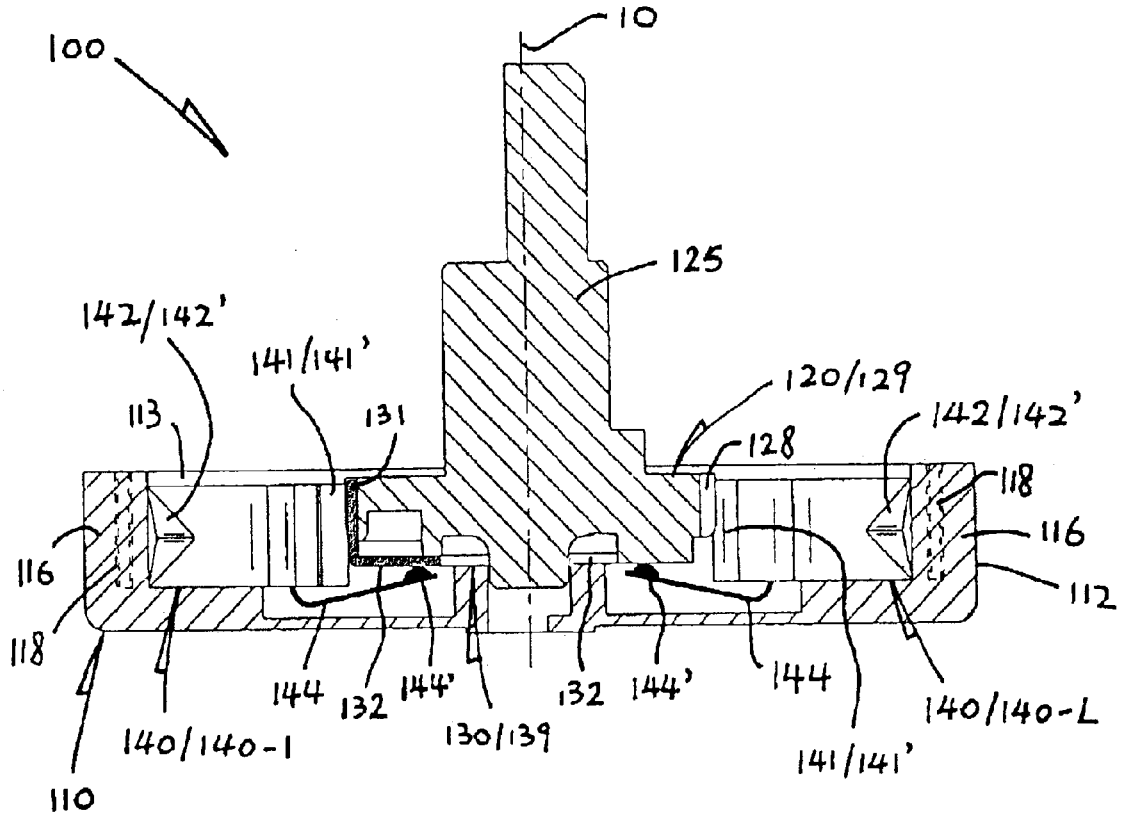
FIG. 3 is a cross-sectional side view of the electrical switch of FIG. 1, taken along line III—III.

Referring to the drawings, there is shown an electrical switch 100 embodying the invention, which switch 100 has a generally flat square casing 110 and a rotor 120 supported centrally within the casing 110 for rotation over 360° in opposite directions about an axis 10 perpendicular to the casing 110. The switch 100 is a rotary switch. The casing 110 comprises a generally flat square base 112 and a square lid 113 closing an open top side of the casing 110. The casing 110 includes four terminal holes 114 at its corners C1 for the insertion of electric cables from a power source and load, or the like.

The rotor 120 has a generally flat cylindrical or disc-like body 129 which includes a peripheral surface 121 extending around the axis 10 and a generally flat bottom surface 122 extending transversely of the axis 10. The peripheral surface 121 has a wavy profile including eight equiangularly spaced (pointed) valleys 128, with the adjacent valleys 128 of each pair separated by a respective convex crest 127. The $1^{st}$ and $4^{th}$ to $6^{th}$ valleys 128 are flattened into respective flat shallow recesses 123. The bottom surface 122 is formed with an arcuate flat shallow recess 124 that extends over 270° (at least 180°) partially round the axis 10.

The rotor 120 includes an integral central shaft 125 that projects vertically upwardly out of the casing 110 through the lid 113 along the axis 10, for fitting with a turning knob (not shown) to facilitate manual rotation of the rotor 120.

The switch 100 includes a moving contact 130 mounted fast on the rotor 120 for rotation therewith. The moving contact 130 has a generally flat body 139 that is folded to form an arcuate flat base 132 and four small side tabs 131 extending at right angles integrally from the outer edge of the base 132.

The recesses 123 and 124 have a combined shape generally complimentary (at least in part) to that of the tabs 131 and base 132, and locate the moving contact 130 fixedly within the surfaces 121 and 122 of the rotor 120. In particular, the recesses 123 and 124 accommodate substantially the entire thickness of the tabs 131 and base 132. This results in the outer surfaces of the moving contact 130 and the rotor 120 lying flush with each other, thereby giving rise to a practically smooth transition across them in either direction of rotation of the rotor 120.

The switch 100 further includes four fixed contacts 140 which are equiangularly located within respective corners C1 of the casing 110 and around the rotor 120, for short-circuiting by the moving contact 130, whereby the switch 100 is closed. Each fixed contact 140 has an integral body 149 comprising a generally Z-shaped base 148 that is bent twice to form a pair of opposite front and rear sections 141 and 142 and a middle section 143 extending therebetween.

The casing 110 has four side walls 116, each of which includes a central protrusion 117 on its inner surface. The adjacent side walls 116 of each pair define one corner C1 and, in conjunction with their central protrusions 117, a generally triangular space over that corner C1 locating the corresponding fixed contact 140. The fixed contact 140 is located by having its two bends at opposite ends of the middle section 143 engaged by opposed corners C2 and C3 between the side walls 116 and their corresponding protrusions 117.

The terminal hole 114 at each corner C1 is positioned on a first of the two associated side walls 116 that forms the corner C2, in close proximity to the second side wall 116 that forms the other corner C3. The inner surface of the second side wall 116 as between the corners C1 and C3 is covered by a metal strip conductor 118 lying there against, which extends across the corners C1 and C3. The conductor 118 is fixed with its first end 118' engaged by a recess 119 at the corner C1 right next to the said inner surface, whilst its second end 118" is pressed against the said inner surface at the other corner C3 by the adjacent bend of the fixed contact 140, i.e. the bend between the first and middle sections 141 and 143. Thus, the conductor 118 is always in electrical contact with the adjacent fixed contact 140, together forming a unitary terminal for electrical connection.

The front section 141 of each fixed contact 140 is shaped generally like a spoon at its free end 141' bearing resiliently against the peripheral surface 121 of the rotor 120 for, in particular, contact with the side tabs 131 of the moving contact 130. This represents a first contact action between the movable and the fixed contacts along the rotor peripheral surface 121.

The four spoon-shaped ends 141' are also engageable with at least one of the pointed valleys 128 of the peripheral surface 121, i.e. those valleys 128 that are not occupied by the tabs 131, to define a total number of eight stable angular positions for the rotor 120.

The fixed contact rear section 142 runs alongside the adjacent casing side wall 116. This contact section 142 has a generally V-sectioned resilient free end 142' which extends across the terminal hole 114 at the corresponding casing corner C1 from behind and reaches short of the first end 118' of the associated conductor 118. The contact end 142' is deflectable inwards by the end of an electric cable inserted through the hole 114.

Upon entry, the cable end, while deflecting the contact end 142' inwards, comes into contact with the inner surface of the conductor 118. As a result, by virtue of its inherent resilience, the contact end 142' presses the cable end against the conductor 118 like a clamp, whereby the contact end 142' and the conductor 118 together provide a double-sided electrical contact to the cable end. The deflected contact end 142' grips the cable end at an acute angle inwards against withdrawal thereof. Thus, a reliable good contact cable connection, that is self-gripping, is made possible.

As is apparent from the drawings, the rear section 142 (providing the end 142' for cable connection) and the middle section 143 (providing the bend for fixing the conductor 118) of the fixed contact 140, including the conductor 118, form a generally triangular structure. This structure has three sides represented by the parts 142, 143 and 118 respectively.

The conductors 118, that being separate parts of the associated fixed contacts 140, can be chosen to be sufficiently thick for use as heat sinks for the corresponding fixed contacts 140, especially given that they are fixed against the casing side walls 116.

The subject switch 100 has a total number of four terminals for connection, namely terminal L for the live circuit of an AC power source and terminals 1, 2 and 3 for a load. For clarity, the fixed contacts 140 associated with the terminals L, 1, 2 and 3 are distinguished by using respective reference numerals 140-L, 140-1, 140-2 and 140-3.

Each of the fixed contacts 140-L and 140-2 at one of the two pairs of diametrically opposite corners C1 of the casing 110 includes an additional contact part 144, compared with the other two fixed contacts 140-1 and 140-3. The additional contact part 144 is in the form of an integral leg 144 that is folded to extend generally at right angles from the bottom edge of the middle section 143 at an intermediate position thereof. As a whole, the fixed contact body 149 concerned is generally T-shaped, or having three legs, prior to the formation of its various part through bending, folding and shaping as described above.

Each contact leg 144 has a free end 144' that is dented from below to form a protruding contact on its upper side bearing resiliently against the bottom surface 122 of the rotor 120 for contact with the arcuate base 132 of the moving contact 130. This represents another, second contact action between the movable and fixed contacts along the rotor bottom surface 122.

Various switching combinations amongst the fixed contacts 140 via the moving contact 130 can be implemented through rotation of the rotor 120, especially given the ability of the fixed contacts 140-L and 140-2 to perform either one or both of the aforesaid contact actions by their legs 144 with the moving contact 130.

The described switch 100 may be used, for example, in an electric heater (or fan) to control its heating elements (or motor). In the simplest form, terminal L acts as a common terminal to which the mains power live circuit is connected, with separate heating elements connected to the other terminals 1, 2 and 3 switchable to terminal L for selective energization. The heating output is adjustable by connecting one or more of the heating elements to the mains power.

Further details of the switch 100 are disclosed in U.S. patent application Ser. No. 10/237,804, the disclosure of which is hereby incorporated by reference.

The invention has been given by way of example only, and various modifications of and/or alterations to the described embodiment may be made by persons skilled in the art without departing from the scope of the invention as specified in the appended claims.

What is claimed is:

1. An electrical switch comprising a casing having a hole for insertion of an electric cable, an operator supported by the casing for movement, and a plurality of fixed contacts and a moving contact in the casing, the moving contact being movable by the operator to come into contact with and out of contact from the fixed contacts, wherein at least one of the fixed contacts has a resilient end positioned behind the hole and deflectable inwards by an end of said cable upon insertion, a part integral with the contact end, and a separate conductor in electrical contact with the contact part and positioned adjacent the contact end, such that the contact end is operable to press said cable end, while being deflected thereby, against the conductor, together providing a double-sided electrical contact to said cable end.

2. The electrical switch as claimed in claim 1, wherein said at least one fixed contact, including the conductor, has a generally triangular structure.

3. The electrical switch as claimed in claim 2, wherein said at least one fixed contact has one section providing the contact end and another section providing the contact part, the two sections together with the conductor representing respective sides of the structure.

4. The electrical switch as claimed in claim 1, wherein said at least one fixed contact comprises a generally Z-shaped body having a front section for contact by the moving contact, a rear section providing the contact end, and a middle section extending therebetween.

5. The electrical switch as claimed in claim 4, wherein the fixed contact body includes a bend between the front and middle sections, the bend providing the contact part.

6. The electrical switch as claimed in claim 1, wherein the casing includes a side wall having an inner surface, lying against which the conductor is fixed.

7. The electrical switch as claimed in claim 6, wherein the conductor has one end engaged by a recess adjacent the inner surface and an opposite end pressed by the contact part against the inner surface.

8. The electrical switch as claimed in claim 1, wherein the operator is supported within the casing for rotation, the fixed contacts are disposed around the operator, and the moving contact is mounted on the operator for rotation therewith.

9. The electrical switch as claimed in claim 8, being a rotary switch with the operator being rotatable over 360° in opposite directions.

* * * * *